US005754103A

United States Patent [19]

Kanai et al.

[11] Patent Number: 5,754,103

[45] Date of Patent: May 19, 1998

[54] TRANSMISSION LINE-MONITORING APPARATUS FOR USE IN A FIRE ALARM SYSTEM

[75] Inventors: Tsutomu Kanai; Toshihiko Shino; Ryuji Oouchi, all of Tokyo, Japan

[73] Assignee: Nohmi Bosai Ltd., Tokyo, Japan

[21] Appl. No.: 512,407

[22] Filed: Aug. 8, 1995

[30] Foreign Application Priority Data

Aug. 18, 1994 [JP] Japan ..... 6-194321

[51] Int. Cl.[6] ..... G08B 29/00

[52] U.S. Cl. ..... 340/507; 340/506; 340/522; 340/531; 340/825.06; 340/825.07

[58] Field of Search ..... 340/521, 506, 340/522, 531, 534, 536, 537, 825.06, 825.07, 825.08

[56] References Cited

U.S. PATENT DOCUMENTS 4,610,012 9/1986 Terada et al. ..... 340/521

FOREIGN PATENT DOCUMENTS 0101172 2/1984 European Pat. Off. .
0581248 2/1994 European Pat. Off. .

*Primary Examiner*—Thomas Mullen
*Assistant Examiner*—Daryl C. Pope
*Attorney, Agent, or Firm*—Wenderoth, Lind & Ponack

[57] ABSTRACT

A transmission line-monitoring apparatus which is able to detect the occurrence of a short circuit even when a line has a large resistance and also to speedily disconnect the short-circuited transmission line upon detection of a short circuit. When a short circuit occurs between branched transmission lines on the output side of the apparatus, a short-circuit detection circuit contained in the transmission-line monitoring apparatus detects this short circuit so as to send a short-circuit detection signal to a line-disconnecting control circuit. Then, the control circuit is operated so as to cause a constant current circuit to interrupt the supply of a base current to a transistor, thereby disconnecting a short-circuited output branched transmission line from a corresponding input branched transmission line.

24 Claims, 8 Drawing Sheets

TRANSMISSION LINE-MONITORING APPARATUS FOR USE IN A FIRE ALARM SYSTEM

BACKGROUND OF THE INVENTION

1. Field of the Invention

The present invention relates to a transmission line-monitoring apparatus which can be used in various fire alarm systems so as to detect the occurrence of a short circuit in the transmission lines of the fire alarm system and to disconnect a short-circuited portion.

2. Description of the Prior Art

Conventionally, in order to prevent a breakdown of a fire alarm system due to a short circuit in a transmission line, the following method is employed, as disclosed in, for example, Japanese Patent Laid-Open No. 62-73400. The voltage between a pair of transmission lines is detected to determine whether a short circuit has occurred. The short-circuited transmission line is disconnected by use of relay contacts.

However, the above-mentioned method in which the occurrence of a short circuit is determined by detecting the voltage between a pair of transmission lines encounters the following problems. A short circuit cannot be detected if the lines have a large resistance. For example, in a fire alarm system in which the maximum allowance of wiring resistance of transmission lines is 30 Ω, the transmission voltage is DC 30V, the maximum transmission current of a fire control panel is 1.2A, and the transmission current during normal monitoring is 0.1A, if a short circuit occurs in a transmission line via wiring resistance of 30 Ω the short circuit current results in 1A (30V/30 Ω1A). Because of this short circuit current, the total current of 1.1A (0.1A+1A=1.1A) disadvantageously continues flowing in the transmission line. Accordingly, a voltage drop is not produced at all in this fire alarm system, whereby a short circuit cannot be detected.

Additionally, since in this method mechanical switches, such as relays or the like, are used to disconnect the transmission line after a short circuit has been detected, a voltage drop due to the occurrence of a short circuit produces an adverse influence on all transmission lines due to the slow operating speed of the relays.

SUMMARY OF THE INVENTION

Accordingly, in order to solve the above problems, an object of the present invention is to provide a transmission line-monitoring apparatus which is able to detect the occurrence of a short circuit even though a transmission line has a large resistance and also to speedily disconnect the short-circuited transmission line upon detection of a short circuit.

In order to achieve the above object, according to the present invention, there is provided a transmission line-monitoring apparatus for use in a fire alarm system, used for monitoring a short circuit in a pair of main transmission lines which extend from a fire control panel and double as power supply lines and signal lines or in at least one pair of branched transmission lines branched off from the main transmission lines, the apparatus comprising: a transistor inserted in at least one of the main transmission lines or the branched transmission lines on the input side of the monitoring apparatus; a constant current circuit connected to the base of the transistor so as to supply a constant base current; a short-circuit detection circuit connected between the emitter and the collector of the transistor so as to generate a short-circuit detection signal indicating that a short circuit has occurred in the transmission lines on the output side when the emitter-collector voltage of the transistor exceeds a predetermined value; and a line-disconnecting control circuit connected to the short-circuit detection circuit so as to cause the transistor to be switched off via the constant current circuit when the line-disconnecting control circuit is operated by the short-circuit detection signal, thereby causing the output transmission line to be disconnected.

The transmission line-monitoring apparatus may comprise an address signal generating circuit.

According to the present invention, the constant current circuit supplies a constant current to the base of the transistor so as to keep the transistor on during normal monitoring. However, upon detection of a short circuit, being operated by a short-circuit detection signal from the short-circuit detection circuit, the line-disconnecting control circuit causes the transistor to be switched off via the constant current circuit so as to disconnect the short-circuited output transmission line of the monitoring apparatus and also to supply a short-circuit signal to the fire control panel directly or via the corresponding transmitter.

Additionally, in this invention, upon detection of a short circuit, the address signal generating circuit supplies an address signal as a short-circuit signal to the fire control panel via the transmission lines.

DESCRIPTION OF THE PREFERRED EMBODIMENTS

A detailed description will now be given of the embodiments of the present invention with reference to the accompanying drawings.

Figure 1:
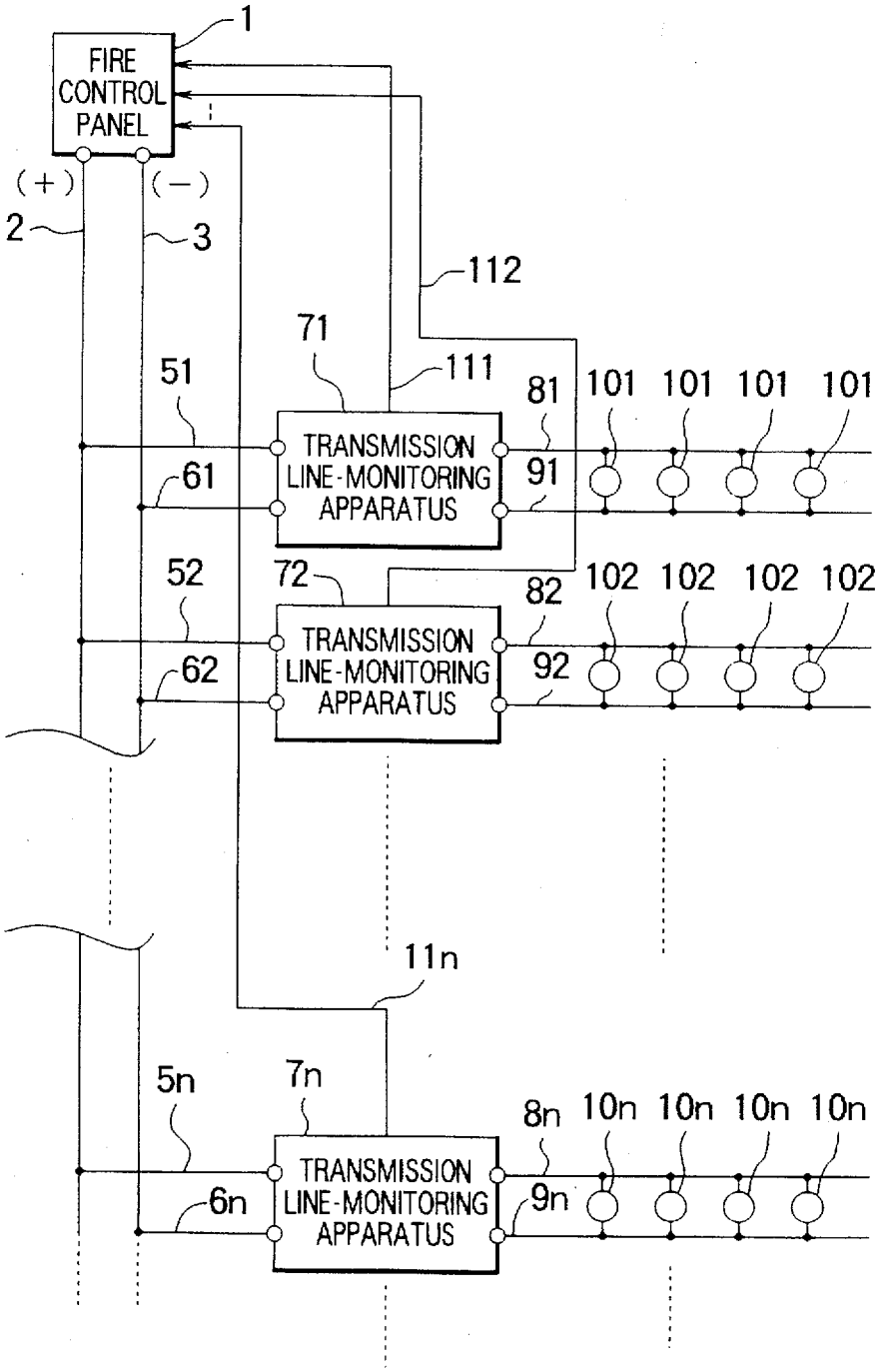
FIG. 1 is a block diagram illustrating one example of a fire alarm system using a transmission line-monitoring apparatus according to the present invention.

FIG. 1 is a block diagram illustrating one example of a fire alarm system using a transmission line-monitoring apparatus according to the present invention. This fire alarm system comprises: a fire control panel 1; a pair of main transmission lines 2 (positive pole) and 3 (negative pole) which double as power supply lines and signal lines extending from the fire control panel 1; at least one pair of branched transmission lines **51-5*n* and 61-6*n* which are branched off from the main transmission lines 2 and 3, respectively; transmission line-monitoring apparatuses 71-7*n* whose input sides are connected to the respective pairs of the branched transmission lines 51 and 61, 52 and 62, . . . 5***n*-6*n*; a pair of branched transmission lines 81-8*n* and 91-9*n* connected to the output sides of the respective monitoring apparatuses 71-7*n*; a plurality of terminal devices 101-10*n*, for example, fire sensors or transmitters, which are connected in parallel to each other between each of the pairs of the branched transmission lines 81 and 91, 82 and 92 . . . 8*n* and 9*n*. Short-circuit signals 111-11*n* output from the respective monitoring apparatuses 71-7*n* are adapted to be directly input to the fire control panel 1. The fire control panel 1 and the terminal devices 101-10*n* are each provided with transmission means (not shown) so that they are able to send and receive various signals.

An explanation will now be given of the operation of the fire alarm system constructed as described above. During normal monitoring, the respective monitoring apparatuses 71-7*n* allow a continuity between the transmission lines. That is, the branched transmission lines 51 and 81, 61 and 91, 52 and 82, 62 and 92, . . . 6*n* and 9*n* are respectively connected to each other. This enables the fire control panel 1 to send and receive transmission signals to/from the terminal devices 101-10*n*.

In this state, if a short circuit occurs between the branched output transmission lines 82 and 92, the monitoring apparatus 72, which is monitoring the transmission lines 82 and 92, detects that the short circuit has occurred and immediately disconnects at least one of the transmission lines 82 from 52, and the transmission lines 92 from 62. In this case, the transmission lines between the fire control panel 1 and the terminal devices 102 are disconnected, but the fire control panel 1 is still able to continue communicating with other terminal devices. In conventional fire alarm systems, all terminal devices are broken down in the event of a short circuit. In the present invention, however, a plurality of transmission line-monitoring apparatuses 71-7*n* are used so that a communication failure occurs only at the branched transmission line at which the short circuit has occurred, thereby remarkably improving the reliability of the fire alarm system. Also, the monitoring apparatus 72 which has detected the occurrence of a short circuit not only disconnects at least one of the branched transmission lines 82 from 52, and the transmission lines 92 from 62, but also directly sends information about the occurrence of a short circuit as a short-circuit signal 112 to the fire control panel 1. According to this information, the fire control panel 1 displays on the panel the monitored area in which the occurrence of a short circuit has been detected, and prints it out. If the fire alarm system shown in FIG. 1 is constructed in such a manner that signals are sent and received between the fire control panel 1 and the terminal devices 101-10*n* according to the polling method, transmission signals are broken down between the terminal devices 102 and the fire control panel 1, and accordingly, the panel 1 also displays/prints that all the terminal devices 102 have encountered abnormal conditions.

Figure 2:
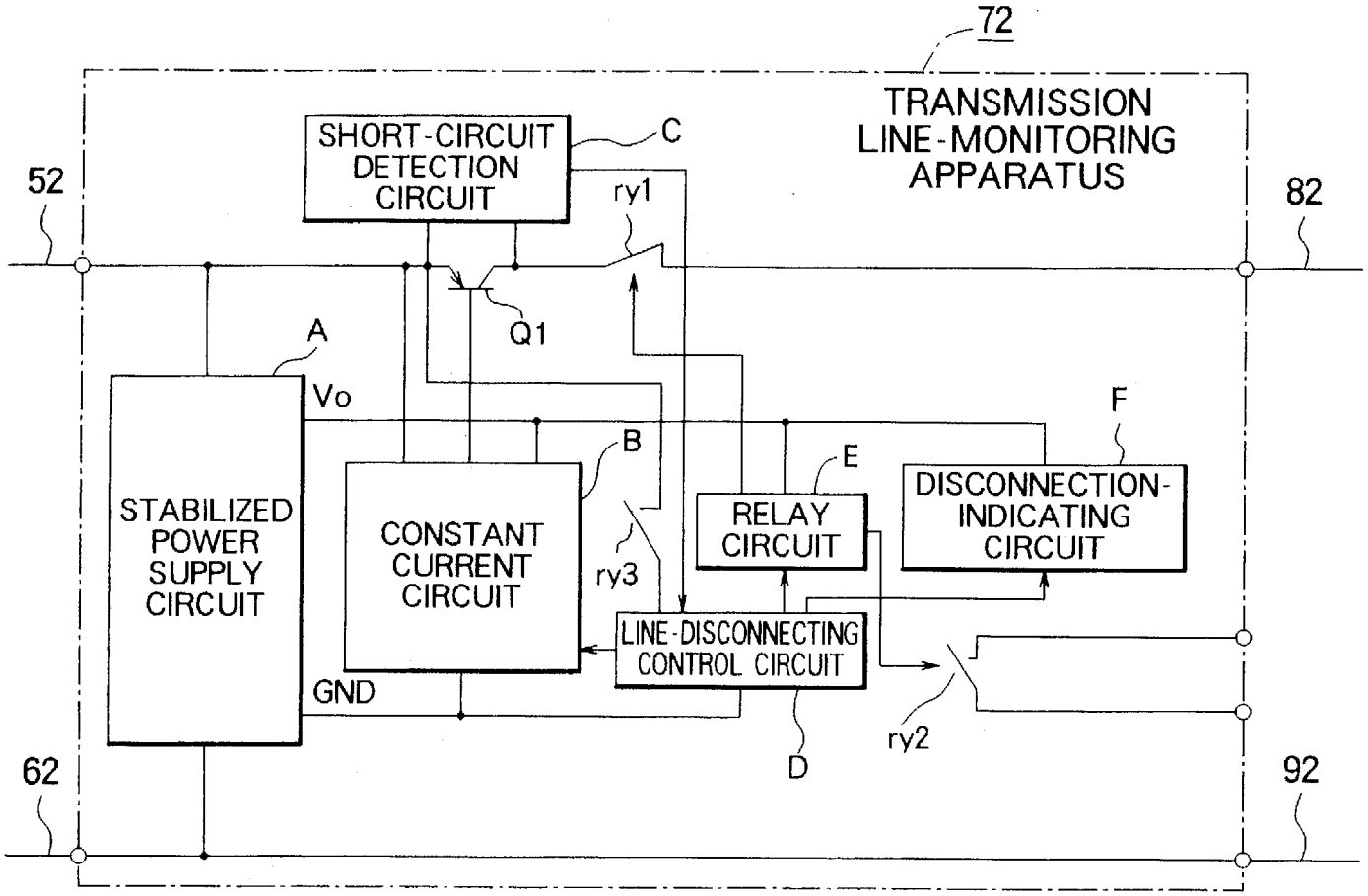
FIG. 2 is a block diagram illustrating an embodiment of the monitoring apparatus shown in FIG. 1 in more detail.

FIG. 2 is a block diagram illustrating an embodiment of the transmission line-monitoring apparatus shown in FIG. 1 in more detail. Since all the monitoring apparatuses 71-7*n* used in the fire alarm system shown in FIG. 1 are identically constructed, only one of the apparatuses, for example, the apparatus 72, is shown in FIG. 2 for better representation. The monitoring apparatus 72 comprises: a PNP-type transistor Q1, by way of example, inserted between the branched transmission lines 52 and 82 (this transistor Q1 may also be inserted between the transmission lines 62 and 92); a stabilized power supply circuit A connected between the transmission lines 52 and 62 so as to supply a power supply voltage $V_o$ to the below-mentioned various circuits; a constant current circuit B connected between the base of the transistor Q1 and a ground GND so as to supply a constant base current to the transistor Q1 during normal monitoring; a short-circuit detection circuit C connected between the emitter and the collector of the transistor Q1 so as to detect the occurrence of a short circuit between the transmission lines 82 and 92 connected to the output side of the apparatus 72; and a line-disconnecting control circuit D which is operated by a short circuit detection signal transmitted from the detection circuit C and thus causes the constant current circuit B to interrupt the supply of a base current to the transistor Q1, thereby disconnecting the short-circuited output transmission line.

The monitoring apparatus 72 also comprises a relay circuit E and a disconnection-indicating circuit F, both of which are connected in parallel to each other between the stabilized power supply circuit A and the line-disconnecting control circuit D. The relay circuit E has a relay (not shown) which further includes a first relay contact ry1 which is driven by the line-disconnecting control circuit D upon the detection of the occurrence of a short circuit so as to disconnect the transistor Q1 from the output transmission line 82, and a second relay contact ry2 for transmitting information concerning the short circuit to the fire control panel 1 (See FIG. 1), and a below-mentioned self-holding third relay contact ry3. The relay contact ry1 is normally switched on and is used for protection from noise when the transistor Q1 is off. The relay contacts ry2 and ry3 are normally switched off.

A description will now be given of the operation of the transmission line-monitoring apparatus 72 constructed as described above. During normal monitoring, since a base current is supplied to the transistor Q1 from the constant current circuit B, the transistor Q1 is kept in the on state. The first relay contact ry1 is closed and the second and third relay contacts ry2 and ry3 are opened, thus establishing continuity between the branched transmission lines 52 and 82, and the transmission lines 62 and 92. In this state, the transmission line-monitoring apparatus 72 monitors the terminal devices 102 connected between the transmission lines 82 and 92 (See FIG. 1). A green indicating lamp (not shown) provided in the constant current circuit B is lit or blinks to indicate that the apparatus 72 is in the monitoring state.

However, if for some reason a short circuit occurs between the transmission lines 82 and 92, the short-circuit detection circuit C detects the occurrence of the short circuit and transmits a short-circuit detection signal to the line-disconnecting control circuit D. Upon receipt of the signal, the line-disconnecting control circuit D is operated to immediately cause the constant current circuit B to interrupt the supply of a base current to the transistor Q1. This interruption causes the transistor Q1 to be switched off so that the short-circuited transmission line 82 and the line 52 can be disconnected. Since this disconnecting operation is performed by interrupting the supply of the base current to the transistor Q1, a voltage drop is barely produced in the branched transmission line 52, and thus, it is very unlikely that a short circuit will develop in other transmission lines. During the disconnecting operation, the line-disconnecting control circuit D sends an operation signal to the relay circuit E and the disconnection-indicating circuit F. This causes the relay circuit E to open the first relay contact ry1 and also to close the relay contacts ry2 and ry3. Simultaneously, the disconnection-indicating circuit F causes a red indicating lamp (not shown) to be lit to indicate that the apparatus is in the line-disconnecting mode. The green lamp is extinguished when the supply of the base current to the transistor Q1 is interrupted. The line disconnecting state is self-held, and recovery is made by restarting the power supply source of the fire control panel 1 (See FIG. 1) or by a manual switch (not shown).

Figure 3:
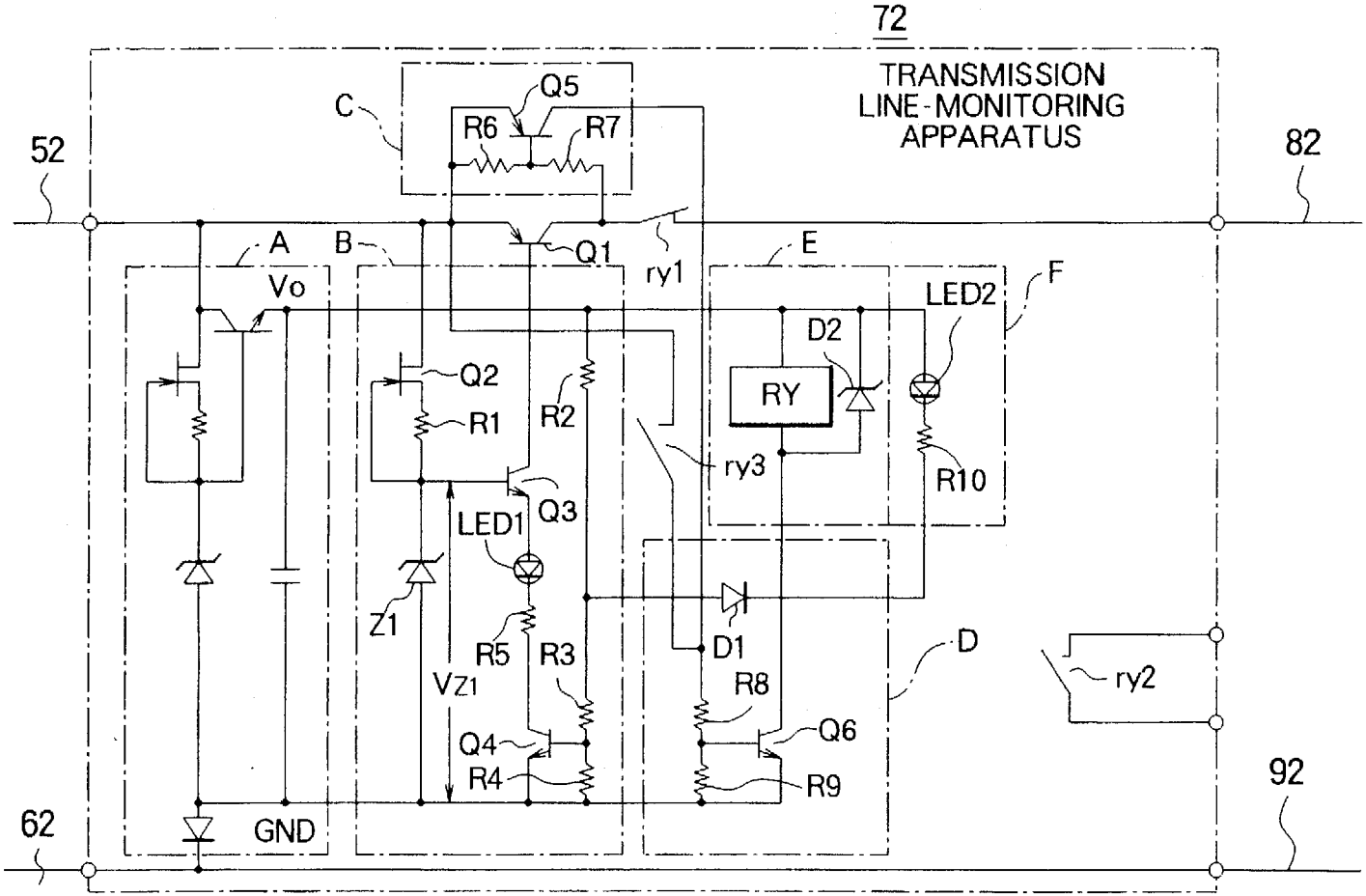
FIG. 3 is a circuit diagram of the monitoring apparatus shown in FIG. 2.

FIG. 3 is a circuit diagram of the transmission line-monitoring apparatus shown in FIG. 2. The stabilized power supply circuit A, which is connected between the branched transmission lines 52 and 62, is constructed as follows by way of example. The circuit A is formed of a field effect transistor (FET), a resistor, a Zener diode, a diode, an NPN-type transistor, and a capacitor. An output voltage $V_o$ is generated at the positive side of the stabilized power supply circuit A, and the negative side thereof serves the function of a ground GND. However, the circuit A may be constructed in a manner differently from the construction shown in FIG. 3 as long as a stabilized constant voltage output can be obtained from the circuit A.

The constant current circuit B includes constant current supplying and biasing means which comprises an FET transistor Q2, a first resistor R1, and a Zener diode Z1 connected in series to each other between the emitter of the transistor Q1 and the ground GND. The FET transistor Q2 and the first resistor R1, which form the constant current supplying means, are also used for suppressing fluctuations of the current consumed due to voltage fluctuations of the transmission lines. If fluctuations of the current consumed are allowed, the FET transistor Q2 may be omitted, in which case, only the first resistor R1 forms the constant current supplying means. The constant current circuit B also comprises the biasing means formed of second, third and fourth resistors R2, R3 and R4, all of which are connected in series to each other across the stabilized power supply circuit A. The constant current circuit B further comprises constant current supplying means formed of a combination of the following elements obtained by connecting them in series to each other: a first NPN-type transistor Q3 whose collector is connected to the base of the transistor Q1 and whose base is connected to the connection point of the first resistor R1 and the Zener diode Z1; a light-emitting diode LED1 connected to the emitter of the first NPN-type transistor Q3 and used as the green lamp for indicating the normal monitoring state; a fifth resistor R5 connected to the light-emitting diode LED1; and a second NPN-type transistor Q4 whose collector is connected to the fifth resistor R5, whose base is connected to the connection point of the third and fourth resistors R3 and R4, and whose emitter is connected to the ground GND. If an indication of the normal monitoring state is not essential, the light emitting diode LED1 may be omitted.

The short circuit detection circuit C comprises sixth and seventh resistors R6 and R7 connected in series to each other between the emitter and the collector of the transistor Q1, and another PNP-type transistor Q5 whose base is connected to the connection point of these sixth and seventh resistors R6 and R7 and whose emitter is connected to the emitter of the transistor Q1.

The line-disconnecting control circuit D comprises eighth and ninth resistors R8 and R9 connected in series to each other between the ground GND and the collector of the transistor Q5 contained in the short circuit detection circuit C, and a third NPN-type transistor Q6 whose base is connected to the connection point of the eighth and ninth resistors R8 and R9, whose emitter is connected to the ground GND, and whose collector is, via a diode D1, connected to the connection point of the second and third resistors R2 and R3 contained in the constant current circuit B. The relay circuit E and the line-disconnection indicating circuit F are connected in parallel to each other between the collector of the third NPN-type transistor Q6 and the positive side of the stabilized power supply circuit A. The relay circuit E includes a relay RY and a reverse current-preventing diode D2 connected in parallel thereto. The indicating circuit F includes another light emitting diode LED2 used as the red lamp for indicating the line-disconnecting state and a tenth resistor R10 connected in series thereto. The relay contact ry3 of the relay RY is connected between the emitter of the transistor Q1 and the collector of the transistor Q5 so as to self-hold the transistor Q6.

Figure 4:
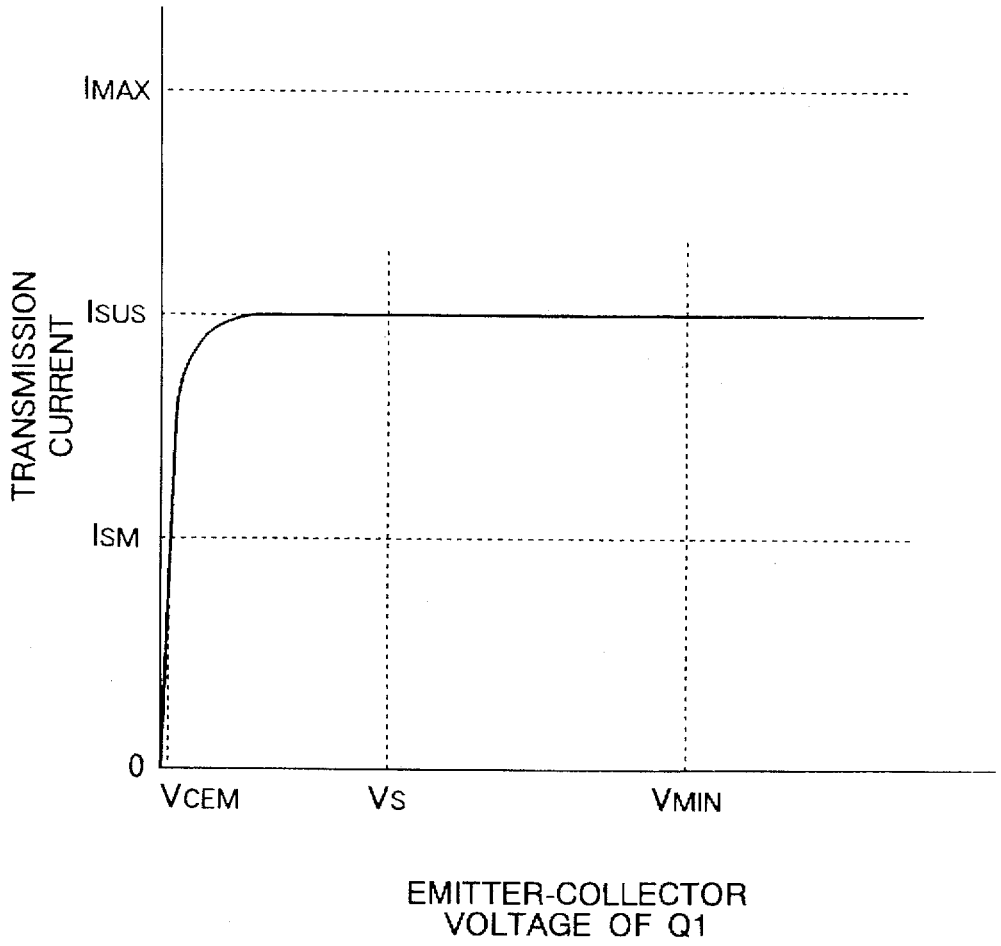
FIG. 4 illustrates the theory of the detection of a short circuit.

The theory for detecting a short circuit performed by the short-circuit detection circuit C will now be explained with reference to FIG. 4. The relationship between the transmission current (collector current) flowing in the transistor Q1 and the emitter-collector voltage of the transistor Q1 can be indicated as shown in FIG. 4. This is because the transistor Q1 is driven by a constant base current supplied by the constant current circuit B. The base current should be selected so that the current $I_{SUS}$ at which the transmission current becomes substantially constant can be set between the short-circuit detection current $I_{MAX}$ of the fire control panel (See FIG. 1) and the maximum current consumed $I_{SM}$ flowing in the terminal devices 102 (See FIG. 1) connected to the transmission line-monitoring apparatus 72, and so that the maximum emitter-collector voltage drop $V_{CEM}$ of the transistor Q1 obtained when the maximum current consumed $I_{SM}$ flows in the terminal devices 102 does not hamper the transmission operation. The threshold value $V_S$ at which the short-circuit detection circuit C detects the occurrence of a short circuit should be selected so that it is greater than the maximum voltage drop $V_{CEM}$ and is also smaller than the minimum emitter-collector voltage $V_{MIN}$ of the transistor Q1 obtained when the maximum wiring resistance is provided between the output transmission lines 82 and 92, as has been discussed above. That is, as illustrated in FIG. 4, the following formula can be established:

$V_{CEM}<V_S<V_{MIN}$ (=transmission voltage of the fire control panel 1−$I_{SUS}$·maximum wiring resistance)

With this threshold value $V_S$ satisfying the above-described formula, a short circuit can be reliably detected even under the condition that a voltage between the branched transmission lines 82 and 92 developed when a short circuit has occurred becomes maximum, that is, when a short circuit has occurred between the transmission lines 82 and 92 via the maximum wiring resistance.

For example, when the transmission voltage is DC 36V, the short-circuit detection current $I_{MAX}$ of the fire control panel 1 is 1.2A, the maximum wiring resistance is 30 Ω and the maximum current consumed $I_{SM}$ of the terminal devices 102 is 0.5A, the current $I_{SUS}$ is set to be 1A to satisfy the condition of the formula: $0.5A<I_{SUS}<1.2A$. The emitter-collector minimum voltage of the transistor Q1 can be further obtained by the following equations:

$$V_{MIN}=DC36V-1A\cdot30\Omega=6V$$

On the other hand, if the maximum emitter-collector voltage drop $V_{CEM}$ is 0.2V when the maximum current consumed of the terminal device flowing in the transistor Q1 is equal to 0.5A, the threshold $V_S$ used for the detection of a short circuit can be selected by the following condition:

$$0.2V<V_S<6V$$

According to the short-circuit detection method described above, a reduction in the transmission voltage due to the occurrence of a short circuit is restricted to the output side of the transmission line-monitoring apparatus 72 which has detected the occurrence of a short circuit, but does not adversely influence other transmission lines.

A specific example of the short-circuit detection circuit C is shown in FIG. 3. The circuit is formed of the sixth and seventh resistors R6 and R7, and the transistor Q5. The emitter-base voltage of the transistor Q5 can be expressed by the formula: the emitter-collector voltage of the transistor Q1·R6/(R6+R7). The values of the resistors R6 and R7 should be set to obtain the emitter-collector voltage of the transistor Q1 which causes the transistor Q5 to be switched on when the voltage becomes equal to or more than the threshold $V_S$, that is, to satisfy the following equation:

$V_S \cdot R6/(R6+R7)=0.6V$ (emitter-base voltage obtained when the transistor Q5 is switched on).

The resistors R6 and R7 should also be set to supply a base current as to enable the transistor Q5 to output a signal current to the line-disconnecting control circuit D.

Although this embodiment has discussed the case in which the base current of the transistor Q1 is constant, there may be provided means for changing the base current supplied to the transistor Q1 according to the amount of current consumed of the terminal devices 102 which are monitored by the monitoring apparatus 72, in which case, the above-described conditions should also be satisfied.

The operation of the transmission line-monitoring apparatus 72 shown in FIG. 3 will now be explained in more detail.

During normal monitoring, the biasing means formed of the resistors R2, R3 and R4 contained in the constant current circuit B receives the voltage $V_o$ supplied from the stabilized power supply circuit A so that the transistor Q4 can be forward-biased by the biasing means so as to be switched on. Further, the Zener diode Z1 receives a current supplied from the constant current supplying means formed of the transistor Q2 and the resistor R1 so as to output a Zener diode voltage $V_{Z_1}$, thereby switching the transistor Q3 on. Accordingly, a constant base current is supplied to the transistor Q1 from the constant current supplying means formed of the Zener diode Z1, the transistor Q3, the light emitting diode LED1, for example, a lamp for indicating the transmission line-monitoring state, the resistor R5, and the transistor Q4, thereby switching the transistor Q1 on. The light emitting diode LED1 is also lit up.

The current supplied from the constant current supplying means formed of the Zener diode Z1, the transistor Q3, the LED1, the resistor R5 and the transistor Q4, that is, the base current IB of the transistor Q1, can be expressed by the following equation:

$$I_B=(V_{Z_1}-V_{BE}(Q3)-V_F(LED1)-V_{CE}(Q4))/R5$$

wherein $V_{Z_1}$ indicates the Zener voltage of the Zener diode Z1; $V_{BE}$ (Q3) denotes the base-emitter voltage of the transistor Q3; $V_F$ (LED1) designates the forward-biasing voltage of the LED1; and $V_{CE}$ (Q4) represents the collector-emitter voltage of the transistor Q4.

During normal monitoring, the transistor Q1 is in the on state during which the emitter-collector voltage of the transistor Q1 is very small, for example, approximately 0.3 V. Accordingly, the transistor Q5 contained in the short-circuit detection circuit C is in the off state so that the short-circuit detection circuit C does not output a short-circuit detection signal to the line-disconnecting control circuit D.

During normal monitoring, as mentioned above, a short-circuit detection signal is not input into the line-disconnecting control circuit D from the short-circuit detection circuit C. Accordingly, the transistor Q6 is in the off state, and the relay RY in the relay circuit E is not excited, whereby the first relay contact ry1 remains closed while the second and third relay contacts ry2 and ry3 remain opened. The light emitting diode LED2 provided in the line-disconnecting indicating circuit F and used as a lamp for indicating the line disconnecting state is in the off state.

However, when a short circuit occurs between the branched transmission lines 82 and 92, the current flowing therebetween soars. Since the base current of the transistor Q1 is constant, the emitter-collector voltage of the transistor Q1 increases in such a manner that it will approach the voltage supplied from the transmission lines 52 and 62. When the emitter-collector voltage $V_{EC}$ (Q1) of the transistor Q1 becomes equal to or more than the voltage expressed by the following equation:

$$V_{EC}(Q1)=(R6+R7)/R6 \cdot V_{EB}(Q5)$$

wherein $V_{EB}$ (Q5) indicates the emitter-base voltage obtained when the transistor Q5 provided in the short-circuit detection circuit C is switched on, the transistor Q5 is switched on so that a short-circuit detection signal can be output from the short-circuit detection circuit C, which further causes the transistor Q6 to be switched on in the line-disconnecting control circuit D. This brings about the occurrence of a short circuit between the resistors R3 and R4 in the constant current circuit B by the diode D1 and the transistor Q6, which further forces the voltage across the resistors R3 and R4 to be reduced and prevents a sufficient supply of the base current to the transistor Q4 which is thus unable to maintain it in the on state. The transistor Q4 is switched off, which further causes the transistor Q3 to be switched off. Accordingly, since the transistors Q3 and Q4 no longer function as the above-described constant current supplying means, the constant current circuit B is unable to supply a base current to the transistor Q1, thus causing the transistor Q1 to be switched off.

The transistor Q1 is thus in the off state, thereby disconnecting the transmission lines 82 from 52. The emitter and the collector of the transistor Q1 are connected to each other via the resistors R6 and R7. Both the resistors R6 and R7 have a resistance at several K Ω or over, the current flowing between the transmission lines 82 and 92 reduces from a range of several hundreds of mA to several A to several mA or less during the occurrence of a short circuit. In this state, the transmission lines 82 and 92 are barely connected with a very small current, or are almost in the same state as when they are disconnected.

When the transistor Q6 is switched on, the relay RY contained in the relay circuit E is driven to open the first relay contact ry1, thus completely disconnecting the output transmission lines 82 and 92. The relay RY is also driven to close the second contact ry2 to send the short-circuit signal 112 (see FIG. 1) to the fire control panel 1 and also to close the third relay contact ry3 to hold the transistor Q6 in the on state.

During this disconnecting operation, the light emitting diode LED2, which is provided in the line-disconnecting indicating circuit F, used as the lamp for indicating the line disconnecting state, is lit. On the other hand, the light emitting diode LED1 is extinguished.

Figure 5:
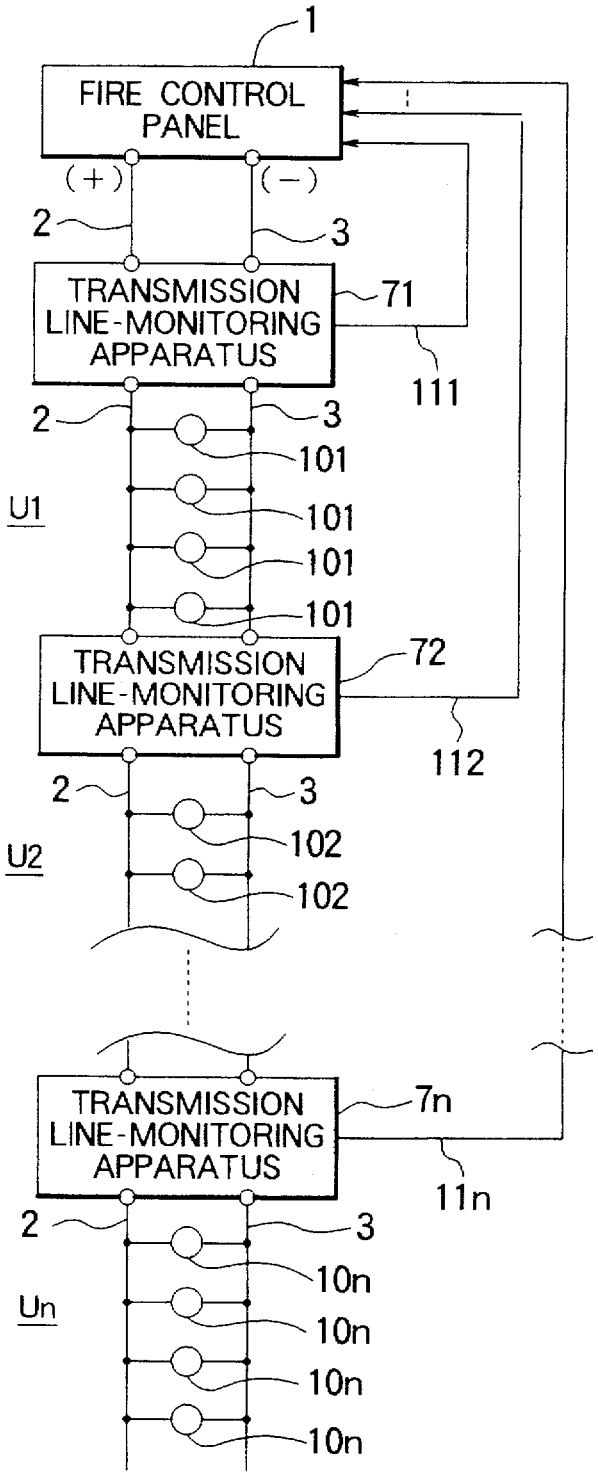
FIG. 5 is a block diagram illustrating another example of a fire alarm system using the transmission line-monitoring apparatus according to the present invention.

FIG. 5 is a block diagram illustrating another example of a fire alarm system using the transmission line-monitoring apparatus of the present invention. This fire alarm system, as well as the system shown in FIG. 1, comprises a fire control panel 1, and a pair of transmission lines 2 and 3. The system of this embodiment further comprises at least one of units U1-Un which are inserted in series to the transmission lines 2 and 3 and are respectively formed of transmission line-monitoring apparatuses 71-7*n* and a plurality of terminal devices 101-10*n*. The terminal devices 101-10*n* are connected in parallel to each other on the output side of each apparatus 71-7*n*.

When a short circuit occurs between the transmission lines 2 and 3 on the output side of the monitoring apparatus 72, the transistor Q1 (See FIG. 2) in the monitoring apparatus 72 is switched off, as has been discussed above. Accordingly, at least one of the transmission lines 2—2 and 3—3 is disconnected, and the relay contact ry2 (see FIG. 2) in the monitoring apparatus 72 is closed, thereby sending the short-circuit signal 112 directly to the fire control panel 1.

Figure 6:
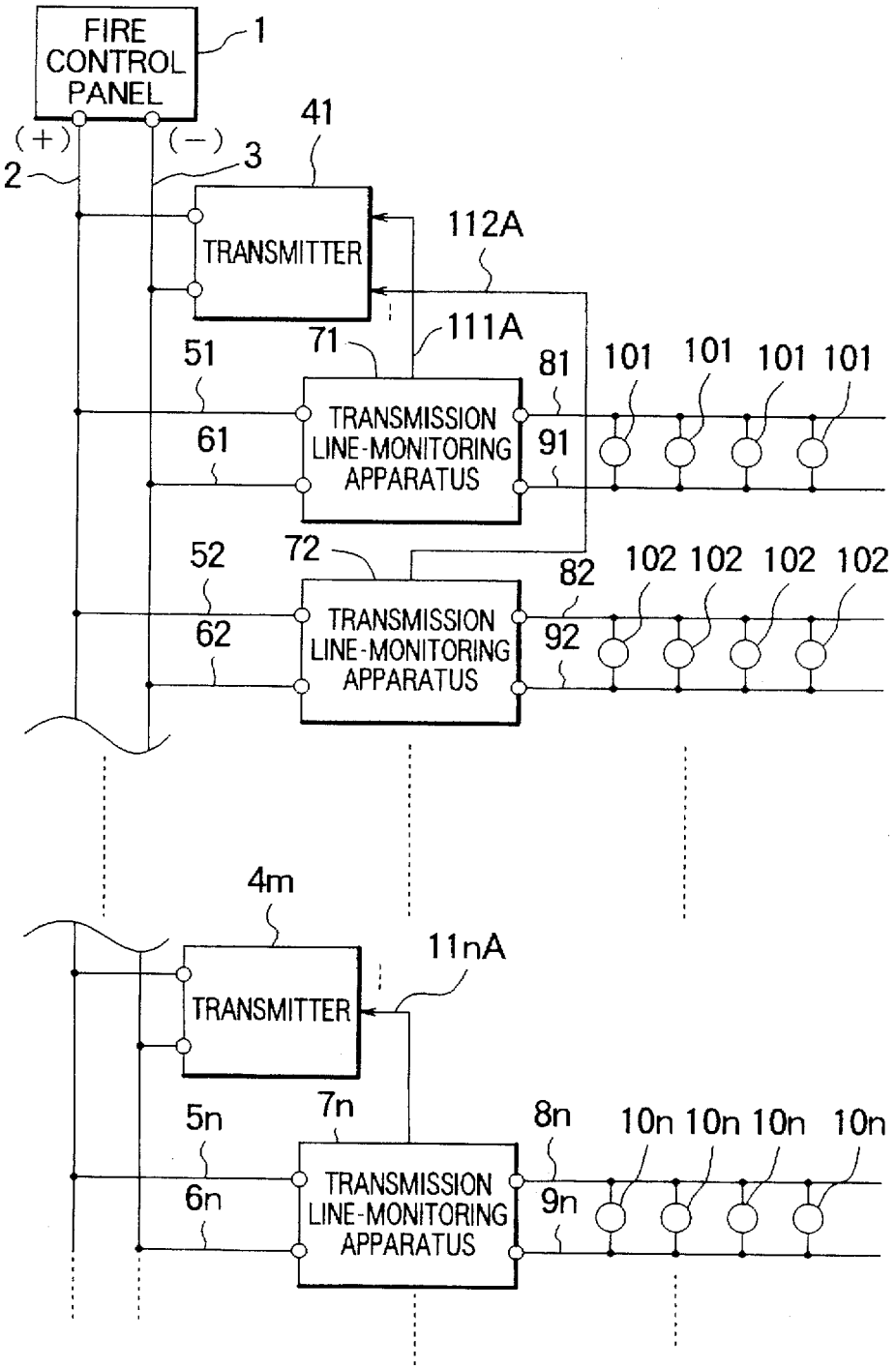
FIG. 6 is a block diagram illustrating still another example of a fire alarm system using the transmission line-monitoring apparatus according to the present invention.

FIG. 6 is a block diagram illustrating still another example of a fire alarm system using the transmission line-monitoring apparatus of the present invention. The fire alarm system of this example is provided with at least one of transmitters 41-4*m*. The respective transmitters 41-4*m* are connected between the transmission lines 2 and 3. For example, they are able to receive short-circuit signals 111A, 112A, . . . 11*n*A transmitted from four monitoring apparatuses 71, 72, . . . 7*n* and also to send and receive various signals.

If a short circuit occurs between the output transmission lines 82 and 92, the monitoring apparatus 72 which has detected the occurrence of the short circuit immediately disconnects at least one of the transmission lines 82 from the line 52, and the transmission lines 92 and 62, and simultaneously, sends the short-circuit signal 112A to the transmitter 41. Upon receipt of the signal 112A, the transmitter 41 notifies the fire control panel 1 of the contents represented by the signal 112A via the transmission lines 2 and 3. According to the information sent from the transmitter 41, the fire control panel 1 displays on the panel the monitored area in which the occurrence of a short circuit has been detected, and prints it out. If the fire alarm system shown in FIG. 6 is constructed in such a manner that the fire control panel 1 sends and receives signals with the transmitters 41-4*m* and the terminal devices 101-10*n* according to the polling method, transmission signals between the terminal devices 102 and the fire control panel 1 are broken down, and accordingly, the panel 1 also displays/prints that all the terminal devices 102 have encountered abnormal conditions.

Figure 7:
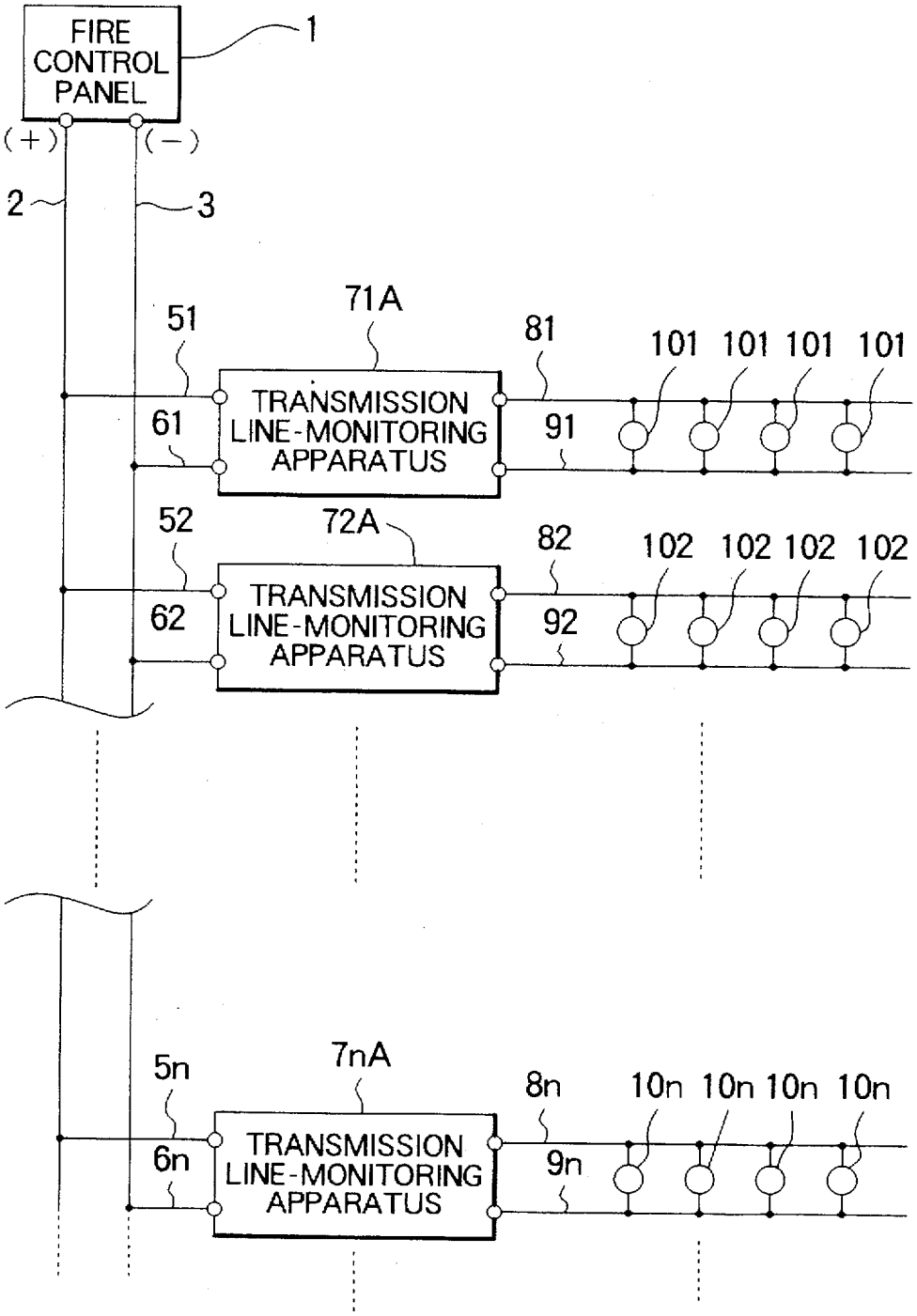
FIG. 7 is a block diagram illustrating yet another example of a fire alarm system using the transmission line-monitoring apparatus according to the present invention.

FIG. 7 is a block diagram illustrating yet another example of a fire alarm system using the transmission line-monitoring apparatus of the present invention. Unlike the fire alarm system shown in FIG. 1 in which the short-circuit signals 111-11*n* are directly sent to the fire control panel 1 from the respective monitoring apparatuses 71-7*n*, the system of this example is constructed in such a manner that different address signals, used as retransmission signals, generated in the monitoring apparatuses 71A-7*n*A, are sent to the fire control panel 1 via the respective branched transmission lines 51-5*n* and the transmission line 2, and via the branched transmission lines 61-6*n* and the transmission line 3.

Figure 8:
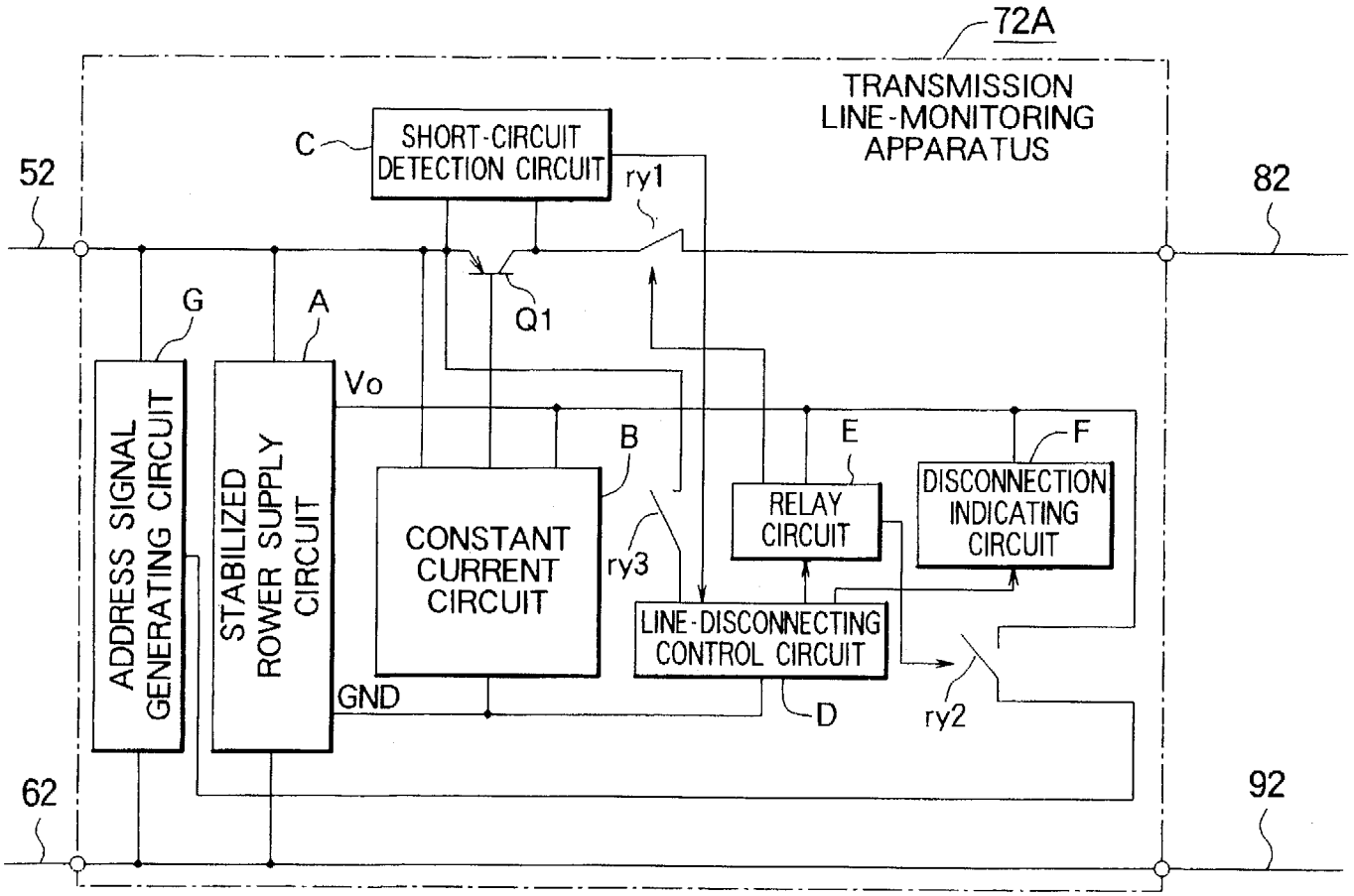
FIG. 8 is a block diagram of another embodiment of the monitoring apparatus shown in FIG. 7 in more detail.

More particularly, FIG. 8 is a block diagram illustrating another embodiment of the transmission line-monitoring apparatus shown in FIG. 7. This monitoring apparatus 72A also comprises an address signal generating circuit G in addition to various components of the monitoring apparatus shown in FIG. 2. The address signal generating circuit G is connected in parallel to the stabilized power supply circuit A and is operated by closing the second relay contact ry2. When operated, the circuit G generates different signals corresponding to the respective monitoring apparatuses 71A-7*n*A, for example, signals at natural frequencies, and sends these signals as the address signals to the fire control panel 1, as has been discussed above. Then, the fire control panel 1 discriminates among the received frequency signals and determines which monitoring apparatus has been operated, thus displaying/printing the monitored area.

Although the transistors Q1 and Q5 are provided at the positive pole of the transmission line as PNP-type transistors, they may be provided at the negative pole of the transmission line as NPN-type transistors.

The operating speed obtained by driving relays, which are conventionally used as the main circuit, is normally from several milli-seconds to ten or so milli-seconds. In contrast, the operating speed obtained by use of transistors as in the present invention is 1 milli-second or less, presenting extremely high response speeds. In the event of a short circuit occurring in a transmission line, a short-circuited portion should be disconnected as quickly as possible in order to minimize damage to the fire control panel or the sensors incurred by the short circuit. For this reason, the present invention uses transistors rather than relays.

As will be clearly understood from the foregoing description, the present invention offers the following advantages.

As has been described in detail, there is provided a transmission line-monitoring apparatus for use in a fire alarm system, used for monitoring a short circuit in a pair of main transmission lines from a fire control panel which double as power supply lines and signal lines or in at least one pair of branched transmission lines branched off from the main transmission lines, the monitoring apparatus comprising: a transistor inserted in at least one of the main transmission lines or the branched transmission lines on the input side of the monitoring apparatus; a constant current circuit connected to the base of the transistor so as to supply a constant base current; a short-circuit detection circuit connected between the emitter and the collector of the transistor so as to generate a short-circuit detection signal representing that a short circuit has occurred in the transmission lines on the output side when the emitter-collector voltage of the transistor exceeds a predetermined value; and a line-disconnecting control circuit connected to the short-circuit detection circuit so as to cause the transistor to be switched off via the constant current circuit when the line-disconnecting control circuit is operated by the short-circuit detection signal, thereby causing the transmission line to be disconnected. With this construction, a short circuit can be reliably detected even when a line voltage is not reduced due to a short circuit occurring via a high resistance. Also, a disconnecting operation is performed very quickly without producing an adverse influence of a voltage drop due to the short circuit on transmission lines other than the short-circuited line, thus remarkably improving the reliability of the system.

Additionally, the line-disconnecting control circuit supplies a short-circuit signal to the fire control panel directly or via a corresponding transmitter. Alternatively, an address signal generating circuit, which is operated upon detection of a short circuit, supplies an address signal as the short-circuit signal to the fire control panel via the transmission lines. With this arrangement, the fire control panel is able to execute required processes based on the short-circuit signal or the address signal.

What is claimed is:

1. A transmission line-monitoring apparatus for use in a fire alarm system which includes a fire control panel, a pair of main transmission lines extending from said fire control panel and doubling as power supply lines and signal lines, at least one pair of branched transmission lines branched off from said main transmission lines, said transmission line-monitoring apparatus connected between said pair of branched transmission lines, a pair of branched transmission lines on the output side of said monitoring apparatus, and a plurality of terminal devices connected in parallel to each other between said pair of branched output transmission lines, said monitoring apparatus comprising:

a transistor inserted in at least one of said pair of branched transmission lines, the emitter and the collector of said transistor being connected in series between said at least one of said pair of branched transmission lines and a corresponding one of said pair of branched output transmission lines;

a constant current circuit connected to the base of said transistor so as to supply a constant base current;

a short-circuit detection circuit connected between the emitter and the collector of said transistor so as to generate a short-circuit detection signal representing that a short circuit has occurred in said pair of branched output transmission lines when the emitter-collector voltage of said transistor exceeds a predetermined value; and a line-disconnecting control circuit connected to said short-circuit detection circuit so as to cause said transistor to be switched off via said constant current circuit when said line-disconnecting control circuit is operated by said short-circuit detection signal, thereby disconnecting said pair of branched output transmission lines.

2. A transmission line-monitoring apparatus for use in a fire alarm system which includes a fire control panel, a pair of transmission lines extending from said fire control panel and doubling as power supply lines and signal lines, and at least one unit inserted in series in said transmission lines, said unit having a transmission line-monitoring apparatus and a plurality of terminal devices connected in parallel to each other on an output side of said monitoring apparatus, said monitoring apparatus comprising:

a transistor inserted in at least one of said transmission lines, the emitter and the collector of said transistor being connected in series between said at least one of said transmission lines and one of a pair of output transmission lines;

a constant current circuit connected to the base of said transistor so as to supply a constant base current;

a short-circuit detection circuit connected between the emitter and the collector of said transistor so as to generate a short-circuit detection signal representing that a short circuit has occurred in said pair of output transmission lines of said monitoring apparatus when the emitter-collector voltage of said transistor exceeds a predetermined value; and a line-disconnecting control circuit connected to said short-circuit detection circuit so as to cause said transistor to be switched off via said constant current circuit when said line-disconnecting control circuit is operated by said short-circuit detection signal, thereby disconnecting said pair of output transmission lines.

3. A transmission line-monitoring apparatus for use in a fire alarm system which includes a fire control panel, a pair of main transmission lines extending from said fire control panel and doubling as power supply lines and signal lines, and at least one transmitter connected to said transmission lines, at least one pair of branched transmission lines branched off from said main transmission lines, the transmission line-monitoring apparatus connected between said pair of branched transmission lines, a pair of branched transmission lines on the output side of said monitoring apparatus, and a plurality of terminal devices connected in parallel to each other between said pair of branched output transmission lines, said monitoring apparatus comprising:

a transistor inserted in at least one of said pair of branched transmission lines, the emitter and the collector of said transistor being connected in series between said at least one of said pair of branched transmission lines and a corresponding one of said pair of branched output transmission lines;

a constant current circuit connected to the base of said transistor so as to supply a constant base current;

a short-circuit detection circuit connected between the emitter and the collector of said transistor so as to generate a short-circuit detection signal representing that a short circuit has occurred in said pair of branched output transmission lines when the emitter-collector voltage of said transistor exceeds a predetermined value; and a line-disconnecting control circuit connected to said short-circuit detection circuit so as to cause said transistor to be switched off via said constant current circuit when said line-disconnecting control circuit is operated by said short-circuit detection signal, thereby disconnecting said pair of output transmission lines.

4. A transmission line-monitoring apparatus according to any one of claims 1, 2 and 3 wherein said transistor is a PNP-type transistor.

5. A transmission line-monitoring apparatus according to any one of claims 1 and 3, further comprising a stabilized power supply circuit connected between said pair of branched transmission lines on the input side of said monitoring apparatus, wherein said constant current circuit is connected in parallel to said stabilized power supply circuit and also connected to a positive pole of said pair of branched transmission lines; said constant current circuit maintains said transistor in the on state during normal monitoring, but interrupts the supply of the base current to said transistor upon detection of a short circuit, thereby causing said transistor to be switched off.

6. A transmission line-monitoring apparatus according to any one of claims 1–3 wherein said short-circuit detection circuit comprises sixth and seventh resistors connected in series to each other between the emitter and the collector of said transistor, and a second transistor, which is a PNP-type transistor, having a base connected to a connection point of said sixth and seventh resistors and an emitter connected to the emitter of said transistor.

7. A transmission line-monitoring apparatus according to any one of claims 1 and 3 wherein said line-disconnecting control circuit drives, when operated by said short-circuit detection signal, a relay to open a first relay contact inserted in series with said transistor, thereby reliably disconnecting the pair of branched output transmission lines, and also to close a second relay contact to supply a short-circuit signal to said fire control panel directly or via a corresponding transmitter.

8. A transmission line-monitoring apparatus according to any one of claims 1, 2 and 3 wherein said line-disconnecting control circuit causes a light emitting diode, used as a lamp for indicating a line disconnecting state, to be lit when it is operated by said short-circuit detection signal.

9. A transmission line-monitoring apparatus according to one of claims 1 and 3, further comprising a stabilized power supply circuit and an address signal generating circuit connected in parallel to each other between said pair of branched transmission lines on the input side of said monitoring apparatus, wherein said constant current circuit is connected in parallel to said stabilized power supply circuit and is also connected to a positive pole of said pair of branched transmission lines and to the base of said transistor so that said constant current circuit supplies, while said pair of branched output transmission lines are monitored, the base current to said transistor to maintain it in the on state, but upon detection of a short circuit, said constant current circuit interrupts the supply of the base current to said transistor so as to cause said transistor to be switched off, and wherein said address signal generating circuit is operated upon detection of a short circuit so as to supply an address signal as a short-circuit signal to said fire control panel via said pair of branched transmission lines.

10. A transmission line-monitoring apparatus according to claim 2, further comprising a stabilized power supply circuit connected between said transmission lines on the input side of said monitoring apparatus, wherein said constant current circuit is connected in parallel to said stabilized power supply circuit and also connected to a positive pole of said pair of transmission lines;

said constant current circuit maintains said transistor in the on state during normal monitoring, but interrupts the supply of the base current to said transistor upon detection of a short circuit, thereby causing said transistor to be switched off.

11. A transmission line-monitoring apparatus according to claim 10 wherein said constant current circuit comprises:

constant current supplying and biasing means formed of at least a first resistor and a Zener diode which are connected in series to each other between the positive pole of said pair of transmission lines and a ground;

biasing means formed of second, third and fourth resistors connected in series to each other across said stabilized power supply circuit;

and constant current supplying means formed of a combination of the following elements obtained by connecting them in series to each other;

a first NPN-type transistor having a collector connected to the base of said transistor and a base connected to a connection point of said first resistor and said Zener diode;

a fifth resistor connected to an emitter of said first NPN-type transistor; and a second NPN-type transistor having a collector connected to said fifth resistor, a base connected to a connection point of said third and fourth resistors, and an emitter connected to the ground.

12. A transmission line-monitoring apparatus according to claim 10 wherein while said pair of output transmission lines are monitored, said constant current circuit maintains said transistor on and also switches on a light emitting diode used as an indicating lamp for indicating a normal monitoring state, but upon detection of a short circuit, said constant current circuit causes said transistor to be switched off and causes said light emitting diode to be extinguished.

13. A transmission line-monitoring apparatus according to claim 12 wherein said constant current circuit comprises said light emitting diode inserted between the emitter of said first NPN-type transistor and the collector of said second NPN-type transistor.

14. A transmission line-monitoring apparatus according to claim 2 wherein said line-disconnecting control circuit drives, when operated by said short-circuit detection signal, a relay to open a first relay contact inserted in series with said transistor, thereby reliably disconnecting said pair of output transmission lines, and also to close a second relay contact to supply a short-circuit signal to said fire control panel directly or via a corresponding transmitter.

15. A transmission line-monitoring apparatus according to claim 11 wherein said short-circuit detection circuit comprises sixth and seventh resistors connected in series to each other between the emitter and the collector of said transistor, and a PNP-type transistor having a base connected to a connection point of said sixth and seventh resistors and an emitter connected to the emitter of said transistor.

16. A transmission line-monitoring apparatus according to claim 15 wherein said line-disconnecting control circuit comprises eight and ninth resistors connected in series to each other between the ground and the collector of said PNP-type transistor contained in said short-circuit detection circuit, and a third NPN-type transistor having a base connected to a connection point of said eight and ninth resistors, an emitter connected to the ground, and a collector connected to a connection point of said second and third resistors contained in said constant current circuit via a diode, a relay and a light emitting diode being connected in parallel to each other between the collector of said third NPN-type transistor and said stabilized power supply circuit.

17. A transmission line-monitoring apparatus according to claim 16 wherein said line-disconnecting control circuit self-holds said third NPN-type transistor by closing a third relay contact connected between the emitter of said transistor and the collector of said PNP-type transistor contained in said-short-circuit detection circuit when said control circuit is operated by said short-circuit detection signal.

18. A transmission line-monitoring apparatus according to claim 5 wherein said constant current circuit comprises: constant current supplying and biasing means formed of at least a first resistor and a Zener diode which are connected in series to each other between the positive pole of said pair of branched transmission lines and a ground; biasing means formed of second, third and fourth resistors connected in series to each other across said stabilized power supply circuit; and constant current supplying means formed of a combination of the following elements obtained by connecting them in series to each other: a first NPN-type transistor having a collector connected to the base of said transistor and a base connected to a connection point of said first resistor and said Zener diode; a fifth resistor connected to an emitter of said first NPN-type transistor; and a second NPN-type transistor having a collector connected to said fifth resistor, a base connected to a connection point of said third and fourth resistors, and an emitter connected to the ground.

19. A transmission line-monitoring apparatus according to claim 5 wherein, while said pair of branched output transmission lines are monitored, said constant current circuit maintains said transistor on and also switches on a light emitting diode used as an indicating lamp for indicating a normal monitoring state, but upon detection of a short circuit, said constant current circuit causes said transistor to be switched off and causes said light emitting diode to be extinguished.

20. A transmission line-monitoring apparatus according to claim 19 wherein said constant current circuit comprises said light emitting diode inserted between the emitter of said first NPN-type transistor and the collector of said second NPN-type transistor.

21. A transmission line-monitoring apparatus according to claim 6 wherein said sixth and seventh resistors contained in said short-circuit detection circuit each have a resistance of several K Ω or greater.

22. A transmission line-monitoring apparatus according to claim 18 wherein said short-circuit detection circuit comprises sixth and seventh resistors connected in series to each other between the emitter and the collector of said transistor, and a PNP-type transistor having a base connected to a connection point of said sixth and seventh resistors and an emitter connected to the emitter of said transistor.

23. A transmission line-monitoring apparatus according to claim 21, 1-3 wherein said line-disconnecting control circuit comprises eighth and ninth resistors connected in series to each other between the ground and the collector of said PNP-type transistor contained in said short-circuit detection circuit, and a third NPN-type transistor having a base connected to a connection point of said eighth and ninth resistors, an emitter connected to the ground, and a collector connected to a connection point of said second and third resistors contained in said constant current circuit via a diode, a relay and a light emitting diode being connected in parallel to each other between the collector of said third NPN-type transistor and said stabilized power supply circuit.

24. A transmission line-monitoring apparatus according to claim 23 wherein said line-disconnecting control circuit self-holds said third NPN-type transistor by closing a third relay contact connected between the emitter of said transistor and the collector of said PNP-type transistor contained in said-short-circuit detection circuit when said control circuit is operated by said short-circuit detection signal.

* * * * *